US009081329B2

(12) United States Patent
Hanamoto et al.

(10) Patent No.: US 9,081,329 B2
(45) Date of Patent: Jul. 14, 2015

(54) DEVELOPING APPARATUS, PROCESS CARTRIDGE, AND IMAGE FORMING APPARATUS

(75) Inventors: Hidetoshi Hanamoto, Mishima (JP); Toshikazu Tsuchiya, Susono (JP); Tsutomu Ishida, Suntou-gun (JP); Shinji Hosoya, Naka-gun (JP); Taku Fukita, Mishima (JP); Hidehiro Ushiozu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 14/111,609

(22) PCT Filed: Apr. 6, 2012

(86) PCT No.: PCT/JP2012/002430

§ 371 (c)(1),
(2), (4) Date: Oct. 14, 2013

(87) PCT Pub. No.: WO2012/144152

PCT Pub. Date: Oct. 26, 2012

(65) Prior Publication Data

US 2014/0044443 A1 Feb. 13, 2014

(30) Foreign Application Priority Data

Apr. 18, 2011 (JP) ..... 2011-092366

(51) Int. Cl.
*G03G 15/08* (2006.01)

(52) U.S. Cl.
CPC ..... *G03G 15/0889* (2013.01); *G03G 15/0862* (2013.01)

(58) Field of Classification Search
CPC ..... G03G 15/0862; G03G 15/0889
USPC ..... 399/27, 254
See application file for complete search history.

(56) References Cited

U.S. PATENT DOCUMENTS

| | | | |
|---|---|---|---|
| 2008/0286005 | A1 | 11/2008 | Ushikubo |
| 2009/0010659 | A1 | 1/2009 | Watanabe |

FOREIGN PATENT DOCUMENTS

| | | | |
|---|---|---|---|
| EP | 665475 | A2 | 8/1995 |
| EP | 1953602 | A1 | 8/2008 |
| JP | 2003-241500 | A | 8/2003 |

*Primary Examiner* — Walter L Lindsay, Jr.
*Assistant Examiner* — Ruth Labombard
(74) *Attorney, Agent, or Firm* — Canon USA Inc IP Division

(57) ABSTRACT

When a stirring member that stirs developer in a developer containing portion rotates at high speed, toner flies and the detection accuracy of light transmission type toner remaining amount detection is degraded. A developing apparatus including a developer containing portion that contains developer, a stirring member that stirs the developer in the developer containing portion, and a partition member which is disposed to separate the developer containing portion from a space adjacent to the developer containing portion and which bends to block at least a part of a light path, which is formed in the space and used to detect an amount of the developer, when being pressed by the stirring member via the developer.

6 Claims, 21 Drawing Sheets

T

| TIME WIDTH (msec) | TONER REMAINING AMOUNT (%) |
|---|---|
| 55.5 | 100 |
| 54.1 | 90 |
| 52.6 | 80 |
| 51.5 | 70 |
| 50.8 | 60 |
| 48.6 | 50 |
| 45.8 | 40 |
| 44.4 | 30 |
| 43.2 | 20 |
| 42.3 | 10 |
| 42.1 | 0 |

Fig. 8C

M

| INPUT VOLTAGE (V) | TONER REMAINING AMOUNT (%) |
|---|---|
| 3.09 | 100 |
| 3.13 | 90 |
| 3.18 | 80 |
| 3.21 | 70 |
| 3.23 | 60 |
| 3.24 | 50 |
| 3.26 | 40 |
| 3.29 | 30 |
| 3.35 | 20 |
| 3.40 | 10 |
| 3.46 | 0 |

Fig. 13B

K

| TIME WIDTH (ms) | TONER REMAINING AMOUNT (%) |
|---|---|
| 83.0 | 5 |
| 86.2 | 10 |
| 91.2 | 15 |
| 94.8 | 20 |
| 97.5 | 25 |
| 99.8 | 30 |
| 101.7 | 35 |
| 103.3 | 40 |
| 104.7 | 45 |
| 106.0 | 50 |
| 107.2 | 55 |
| 108.3 | 60 |
| 109.3 | 65 |
| 110.2 | 70 |
| 111.0 | 75 |
| 111.8 | 80 |
| 112.6 | 85 |
| 113.3 | 90 |
| 114.0 | 95 |
| 114.6 | 100 |

DEVELOPING APPARATUS, PROCESS CARTRIDGE, AND IMAGE FORMING APPARATUS

TECHNICAL FIELD

The present invention relates to a developing apparatus used in an electrophotographic image forming apparatus such as a laser printer, a copying machine, and a facsimile.

BACKGROUND ART

In an electrophotographic image forming apparatus, a toner remaining amount detection apparatus for measuring the remaining amount of toner contained in a toner container may be provided. There are various methods used in the toner remaining amount detection apparatuses. For example, there is a light transmission type toner remaining amount detection method as described in PTL 1. The light transmission type toner remaining amount detection method is a method in which detection light is transmitted through a toner container and the remaining amount of toner contained in the toner container is detected by using transmission time of the detection light.

In PTL 1, a stirring member rotates in the toner container, so that the toner is stirred. The transmission time of the detection light is measured for each rotation cycle of the stirring member. When a large amount of toner is contained in the toner container, the detection light is not transmitted through the container, and as the toner is consumed, the detection light is increasingly transmitted through the container. Therefore, the remaining amount of toner is detected by using a phenomenon that a time period in which the detection light is detected increases as the toner is consumed.

CITATION LIST

Patent Literature

PTL 1: Japanese Patent Laid-Open No. 2003-241500

SUMMARY OF INVENTION

Technical Problem

In a conventional image forming apparatus, the remaining amount of toner is detected by the light transmission type toner remaining amount detection apparatus as described above while image forming speed (process speed) is increased and rotation speed of the stirring member is also increased according to the image forming speed in order to improve print productivity (print speed). Therefore, the driving speed of the stirring member is fast, so that the toner in the toner container flies and becomes a cloud of toner. Therefore, the time period in which the detection light is transmitted through the toner container is unstable and the detection accuracy of the amount of remaining tonner degrades.

Solution to Problem

An aspect of the present invention provides a developing apparatus including a developer containing portion that contains developer, a developer bearing member that bears developer and develops an electrostatic latent image, a flexible stirring member that stirs the developer in the developer containing portion, and a partition member which is disposed to separate the developer containing portion from a space adjacent to the developer containing portion and which bends to block at least a part of a light path, which is formed in the space and used to detect an amount of the developer, when being pressed by the stirring member via the developer.

Advantageous Effects of Invention

A light path for detecting the amount of developer is formed in a space separated from the developer containing portion, so that it is possible to accurately detect the amount of remaining developer with a simple configuration even when the stirring member rotates at high speed in the developer containing portion and toner flies.

BRIEF DESCRIPTION OF DRAWINGS

FIG. 1 is a schematic diagram showing a configuration of a color laser printer according to the present invention.

FIG. 2A is a cross-sectional view of an optical sensor unit according to a first embodiment.

FIG. 2B is a cross-sectional view of the optical sensor unit according to the first embodiment.

FIG. 2C is a cross-sectional view of the optical sensor unit according to the first embodiment.

FIG. 3 is a perspective view of a process cartridge and a cross-sectional perspective view of a developing unit according to the first embodiment.

FIG. 4 is a circuit diagram according to the first embodiment.

FIG. 5A is a characteristic graph according to the first embodiment.

FIG. 5B is a waveform according to the first embodiment.

FIG. 5C is a table T according to the first embodiment.

FIG. 6 is a sequence flowchart according to the first embodiment.

FIG. 7A is a cross-sectional view of a developing unit according to a second embodiment.

FIG. 7B is a cross-sectional view of the developing unit according to the second embodiment.

FIG. 7C is a perspective view of a stifling sheet according to the second embodiment.

FIG. 8A is a characteristic graph according to the second embodiment.

FIG. 8B is a waveform according to the second embodiment.

[FIG. 8C]

FIG. 8C is a table M according to the second embodiment.

FIG. 9 is a sequence flowchart according to the second embodiment.

FIG. 10A is a cross-sectional view of an optical sensor unit according to a third embodiment.

FIG. 10B is an outside view of a light blocking plate according to the third embodiment.

FIG. 11 is a circuit diagram according to the third embodiment.

FIG. 12 is a waveform according to the third embodiment.

FIG. 13A is a characteristic graph according to the third embodiment.

[FIG. 13B]

FIG. 13B is a table K according to the third embodiment.

FIG. 14 is a sequence flowchart of LED light quantity initial setting according to the third embodiment.

FIG. 15 is a sequence flowchart of toner remaining amount detection according to the third embodiment.

FIG. 16A is a cross-sectional view of an optical sensor unit according to a fourth embodiment.

FIG. 16B is an outside view of a light blocking plate according to the fourth embodiment.

FIG. 16C is a perspective view of the light blocking plate and a light blocking plate fixing platform according to the fourth embodiment.

FIG. 17A is a cross-sectional view of an optical sensor unit according to a fifth embodiment.

FIG. 17B is an outside view of a light blocking plate according to the fifth embodiment.

FIG. 17C is a diagram for explaining a mechanism according to the fifth embodiment.

FIG. 17D is a diagram for explaining the mechanism according to the fifth embodiment.

FIG. 17E is a diagram for explaining the mechanism according to the fifth embodiment.

FIG. 17F is a diagram for explaining the mechanism according to the fifth embodiment.

FIG. 18A is a cross-sectional view of an optical sensor unit according to a sixth embodiment.

FIG. 18B is an outside view of a light blocking plate according to the sixth embodiment.

FIG. 18C is a perspective view of the light blocking plate and a light blocking plate fixing platform according to the sixth embodiment.

DESCRIPTION OF EMBODIMENTS

Hereinafter, embodiments of the present invention will be described with reference to the drawings. The embodiments described below do not limit the claims of the present invention. Also, all combination of the features described in the embodiments are not necessarily required in the solution means of the present invention.

First Embodiment

Figure 1:
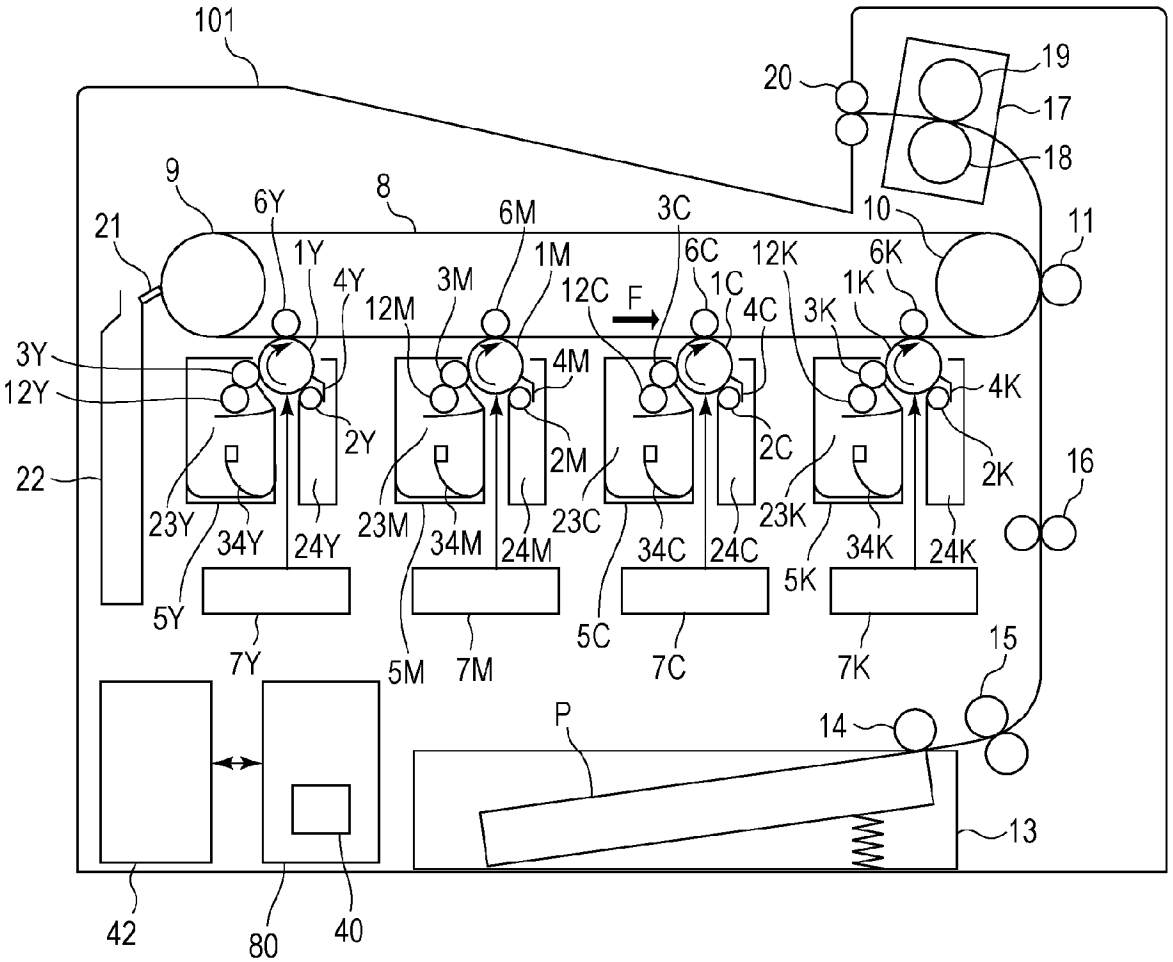
[FIG. 1]

FIG. 1 is a schematic diagram of a configuration of a "color laser printer" according to the present embodiment.

The color laser printer (hereinafter referred to as a main body) shown in FIG. 1 includes process cartridges 5Y, 5M, 5C, and 5K attachable and detachable to and from the main body 101. Although the four process cartridges 5Y, 5M, 5C, and 5K have the same structure, the process cartridges are different from each other in a point that the process cartridges forms images of toners of different colors, that is, yellow (Y), magenta (M), cyan (C), and black (K) respectively. The process cartridges 5Y, 5M, 5C, and 5K mainly include three units, that is, a developing unit, an image forming unit, and a waste-toner unit. Each developing unit respectively includes developing rollers 3Y, 3M, 3C, and 3K, toner supply rollers 12Y, 12M, 12C, and 12K, toner containers (developer containing portions) 23Y, 23M, 23C, and 23K, and stirring sheets 34Y, 34M, 34C, and 34K.

Each image forming unit respectively includes photosensitive drums 1Y, 1M, 1C, and 1K, which are image bearing members, and charging rollers 2Y, 2M, 2C, and 2K. Each waste-toner unit respectively includes drum cleaning blades 4Y, 4M, 4C, and 4K and waste-toner containers 24Y, 24M, 24C, and 24K.

Laser units 7Y, 7M, 7C, and 7K are arranged below the process cartridges 5Y, 5M, 5C, and 5K. The laser units 5Y, 5M, 5C, and 5K expose the photosensitive drums 1Y, 1M, 1C, and 1K on the basis of an image signal. The photosensitive drums 1Y, 1M, 1C, and 1K are charged to a predetermined negative potential by the charging rollers 2Y, 2M, 2C, and 2K. Thereafter, the laser units 7Y, 7M, 7C, and 7K form electrostatic latent images on the photosensitive drums 1Y, 1M, 1C, and 1K respectively. The electrostatic latent images are developed reversely by the developing rollers 3Y, 3M, 3C, and 3K and negatively charged toner is attached to the electrostatic latent images, so that toner images (developer images) of Y, M, C, and K are formed on the electrostatic latent images respectively.

An intermediate transfer belt unit includes an intermediate transfer belt 8, a driving roller 9, and a secondary transfer opposing roller 10. Primary transfer rollers 6Y, 6M, 6C, and 6K facing the photosensitive drums 1Y, 1M, 1C, and 1K are arranged inside the intermediate transfer belt 8. A bias applying unit not shown in FIG. 1 applies a transfer bias to the primary transfer rollers 6Y, 6M, 6C, and 6K.

The toner images formed on the photosensitive drums 1Y, 1M, 1C, and 1K rotate along with the photosensitive drums 1Y, 1M, 1C, and 1K and the intermediate transfer belt 8 is rotated in a direction indicated by an arrow F. Further, a positive bias is applied to the primary transfer rollers 6Y, 6M, 6C, and 6K, so that the toner images are sequentially primarily transferred to the intermediate transfer belt 8 in order from the toner image on the photosensitive drum 1Y and the four toner images are superimposed on the intermediate transfer belt 8 and conveyed to a secondary transfer roller 11.

A feeding/conveying device includes a feed roller 14 that feeds a transfer medium P from a feeding cassette 13 containing the transfer media P and a conveying roller pair 15 that conveys the fed transfer medium P. The transfer medium P conveyed from the feeding/conveying device is conveyed to the secondary transfer roller 11 by a registration roller pair 16.

When the toner images are transferred from the intermediate transfer belt 8 to the transfer medium P, a positive bias is applied to the secondary transfer roller 11, so that the four-color toner images on the intermediate transfer belt 8 are secondarily transferred to the conveyed transfer medium P. The transfer medium P on which the toner images are transferred is conveyed to a fixing device 17 and heated and pressed by a fixing film 18 and a pressure roller 19, so that the toner images are fixed to a surface of the transfer medium P. The transfer medium P to which the toner images are fixed is discharged by a discharge roller pair 20.

On the other hand, toners remaining on surfaces of the photosensitive drums 1Y, 1M, 1C, and 1K after the toner images are transferred are removed by the drum cleaning blades 4Y, 4M, 4C, and 4K and the removed toners are collected into the waste-toner containers 24Y, 24M, 24C, and 24K. Toners remaining on the intermediate transfer belt 8 after the toner images are transferred to the transfer medium P are removed by a transfer belt cleaning blade 21 and the removed toners are collected into a waste-toner container 22.

Reference numeral 80 in FIG. 1 denotes a control board on which an electrical circuit for controlling the main body is mounted. A one-chip microcomputer (hereinafter referred to as CPU) 40 is mounted on the control board 80. The CPU 40 collectively controls operations of the main body, such as control of a driving source (not shown in FIG. 1) related to conveying the transfer medium P and a driving source (not shown in FIG. 1) of the process cartridges, control related to image forming, and control related to failure detection. Reference numeral 42 denotes a video controller for controlling laser light emitting in the laser units from image data. The video controller 42 also performs user interface functions via a control panel not shown in FIG. 1. The amounts of remaining toners of each color are displayed on the control panel as a bar graph. The symbols Y, M, C, and K indicate colors. In the description below, the symbols Y, M, C, and K that indicate colors will be omitted.

Figure 2A:
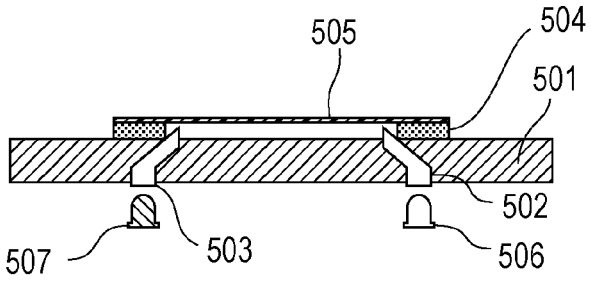
[FIG. 2A]

An optical sensor unit which functions as a toner remaining amount sensor will be described. FIG. 2A is a cross-sectional view of the optical sensor unit of the present embodiment. A light guide 502 and a light guide 503 which are a pair of light guides are arranged in a developing unit wall 501 with front ends thereof facing each other. Each light guide has end faces on an outer wall and an inner wall of the developing unit. A double-sided tape 504, which is a sheet whose both sides are adhesive, is attached to the inner wall of the developing unit as a spacer so that the double-sided tape 504 encloses the pair of the light guides. Reference numeral 505 denotes a PET film formed of a sheet-shaped member (partition member) having flexibility. The PET film 505 is attached to the double-sided tape 504. The double-sided tape 504 is a spacer which forms a space (first space) between the inner wall 501 of the developing unit and the PET film 505. In other words, the PET film 505 is disposed to separate the toner container 23 from the first space adjacent to the toner container 23. The double-sided tape 504 has a function to attach the PET film 505 in addition to a function of a spacer.

An LED 506 which is a light-emitting device is provided at a position facing the end face of the light guide 502 on the outer wall of the developing unit in the image forming apparatus. Similarly, a phototransistor 507 which is a photo detector is provided at a position facing the end face of the light guide 503 on the outer wall of the developing unit in the image forming apparatus. Infrared light emitted from the LED 506 is guided through the light guide 502, transmitted through the space formed between the inner wall 501 of the developing unit and the PET film 505, and received by the phototransistor 507 through the light guide 503.

The PET film 505 is a detection surface for detecting the amount of toner remaining in the toner container. When a pressure is applied to the PET film 505, the PET film 505 is deformed and the space formed between the inner wall 501 of the developing unit and the PET film 505 becomes small, so that a light path for detecting the amount of developer between the LED 506 and the phototransistor 507 is blocked.

FIG. 2A shows a state in which no pressure is applied to the detection surface of the optical sensor unit. The size of the space between the inner wall 501 of the developing unit and the PET film 505 is largest, so that the light quantity transmitting through the space is large.

Figure 2B:
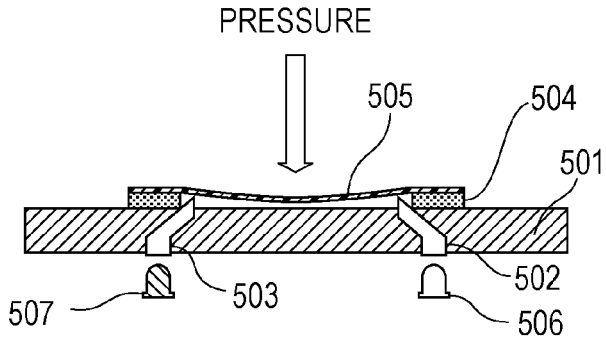
[FIG. 2B]
Figure 2C:
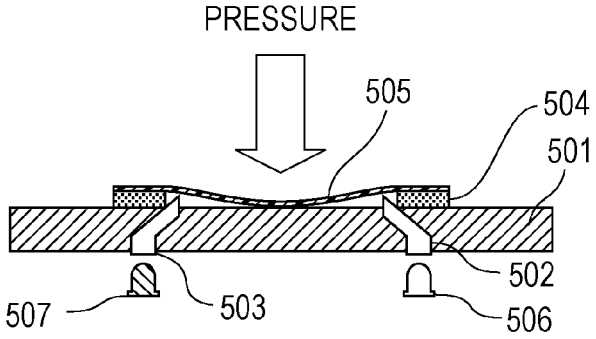
[FIG. 2C]

FIG. 2B shows a state in which a small pressure is applied to the detection surface of the optical sensor unit. The PET film 505 is deformed and the space formed between the inner wall 501 of the developing unit and the PET film 505 becomes small. Therefore, the light transmitting through the space is partially blocked, so that the received light quantity is smaller than that in FIG. 2A. On the other hand, FIG. 2C shows a state in which a large pressure is applied to the detection surface of the optical sensor unit. The PET film 505 is largely deformed and a part of the PET film 505 comes into contact with the inner wall 501 of the developing unit, so that most of the light emitted from the LED 506 is blocked.

Figure 3:
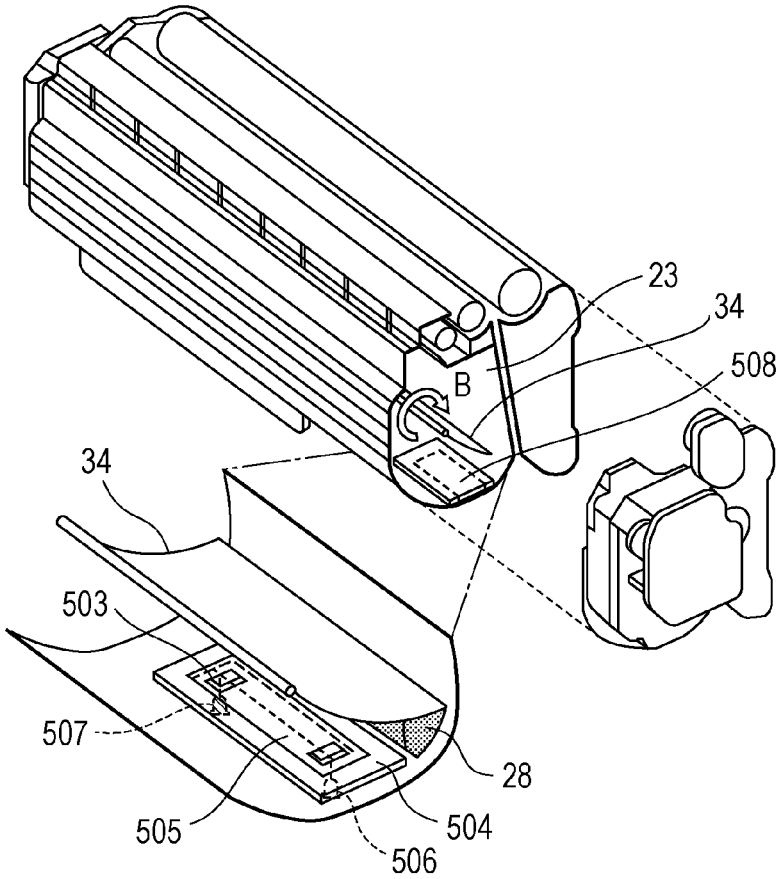
[FIG. 3]

FIG. 3 is a cross-sectional perspective view of the developing unit. There is a stirring sheet (stirring member) 34 for stirring the toner in the toner container 23. Here, the thickness of the stirring sheet 34 is 150 micrometer. The stirring sheet 34 has flexibility. The stirring sheet 34 rotates at a speed of about 1 rotation/sec in a direction indicated by an arrow B.

When the stirring sheet 34 rotates, as shown in FIG. 3, the stirring sheet 34 is subjected to the resistance of the toner and deformed in the backward direction of rotation, so that the stirring sheet 34 bends largely. When a large amount of toner remains, the time period in which the stirring sheet 34 passes over the optical sensor unit 508 is long, so that the time period in which pressure is applied to the detection surface of the optical sensor unit 508 is long. When there is a large amount of toner, there is also a large amount of toner which is pressed between the stirring sheet 34 and the optical sensor unit 508, so that the time period in which the stirring sheet 34 and the toner apply pressure to the detection surface of the optical sensor unit 508 is long. On the other hand, when there is a small amount of remaining toner, the resistance of the toner is small, so that the amount of bend of the stirring sheet 34 is small. As a result, the time period in which the stirring sheet 34 passes over the optical sensor unit 508 is short, so that the time period in which pressure is applied to the detection surface of the optical sensor unit 508 is short. When there is a small amount of toner, there is also a small amount of toner between the stirring sheet 34 and the optical sensor unit 508, so that the time period in which pressure is applied to the detection surface of the optical sensor unit 508 is short. The remaining amount of the toner 28 is detected by using the principle described above.

Figure 4:
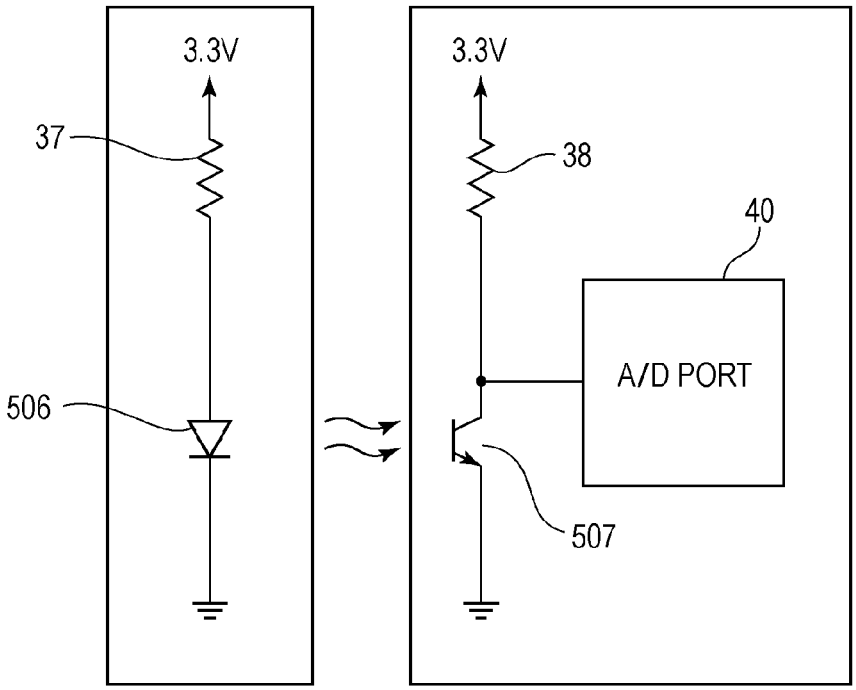
[FIG. 4]

FIG. 4 is a circuit diagram showing a detection unit that detects the amount of remaining toner. The anode of the LED 506 that is a light-emitting device is connected to a power supply voltage of (DC) 3.3 V through a fixed resistor 37 that is a current limiting resistor, and the cathode of the LED 506 is connected to the ground. On the other hand, reference numeral 38 denotes a fixed resistor, which is connected to the collector of the phototransistor 507 whose emitter is connected to the ground. A collector voltage of the phototransistor 507 is inputted into an A/D port of the CPU 40. When the phototransistor 507 receives light, a collector current which is a photoelectric current flows and the collector voltage of the phototransistor 507 lowers.

Next, the detection characteristics of the toner remaining amount detection according to the present embodiment will be described with reference to FIG. 5.

Figure 5A:
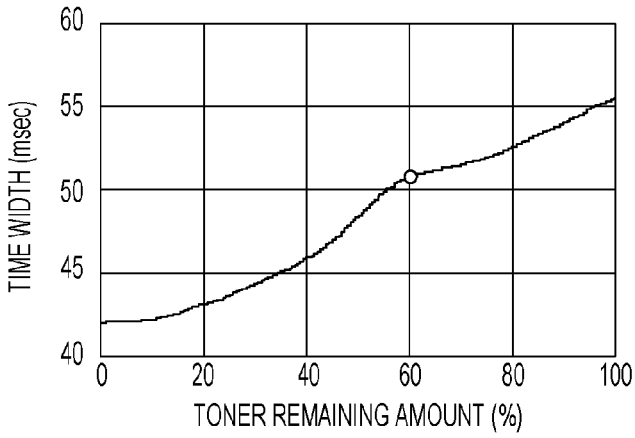
[FIG. 5A]
Figures 5B, 5C:
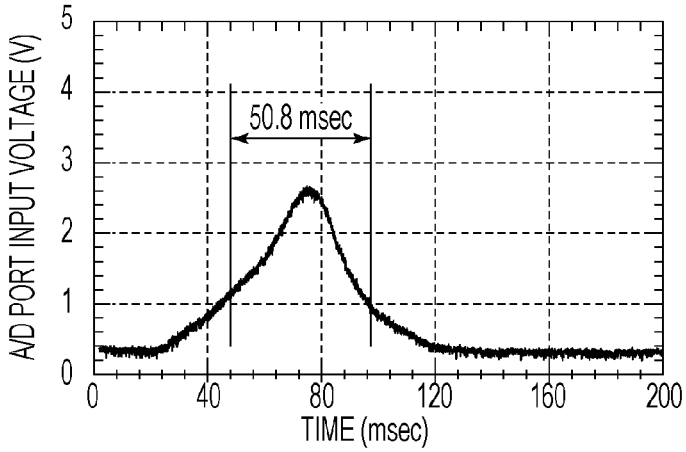
[FIG. 5B]
[FIG. 5C]

FIG. 5A a characteristic graph of the amount of remaining toner and the time width from when the toner pressed by the stirring sheet 34 reaches the detection surface of the optical sensor unit 508 to when the front edge of the stirring sheet 34 passes over the detection surface of the optical sensor unit 508. FIG. 5B is waveform data when the amount of remaining toner is 60%. The stirring sheet and the toner pressed by the stirring sheet press and deform the PET film, so that the light is blocked in the optical sensor unit 508 for about 50.8 msec.

FIG. 5C is a table T. The amounts of remaining toner between the values in the table are calculated by a known linear interpolation. Here, the calculated time is a value in the present embodiment, so that when the condition changes, the calculated time also changes. The same is true for the values in the table for calculating the amount of remaining toner.

Figure 6:
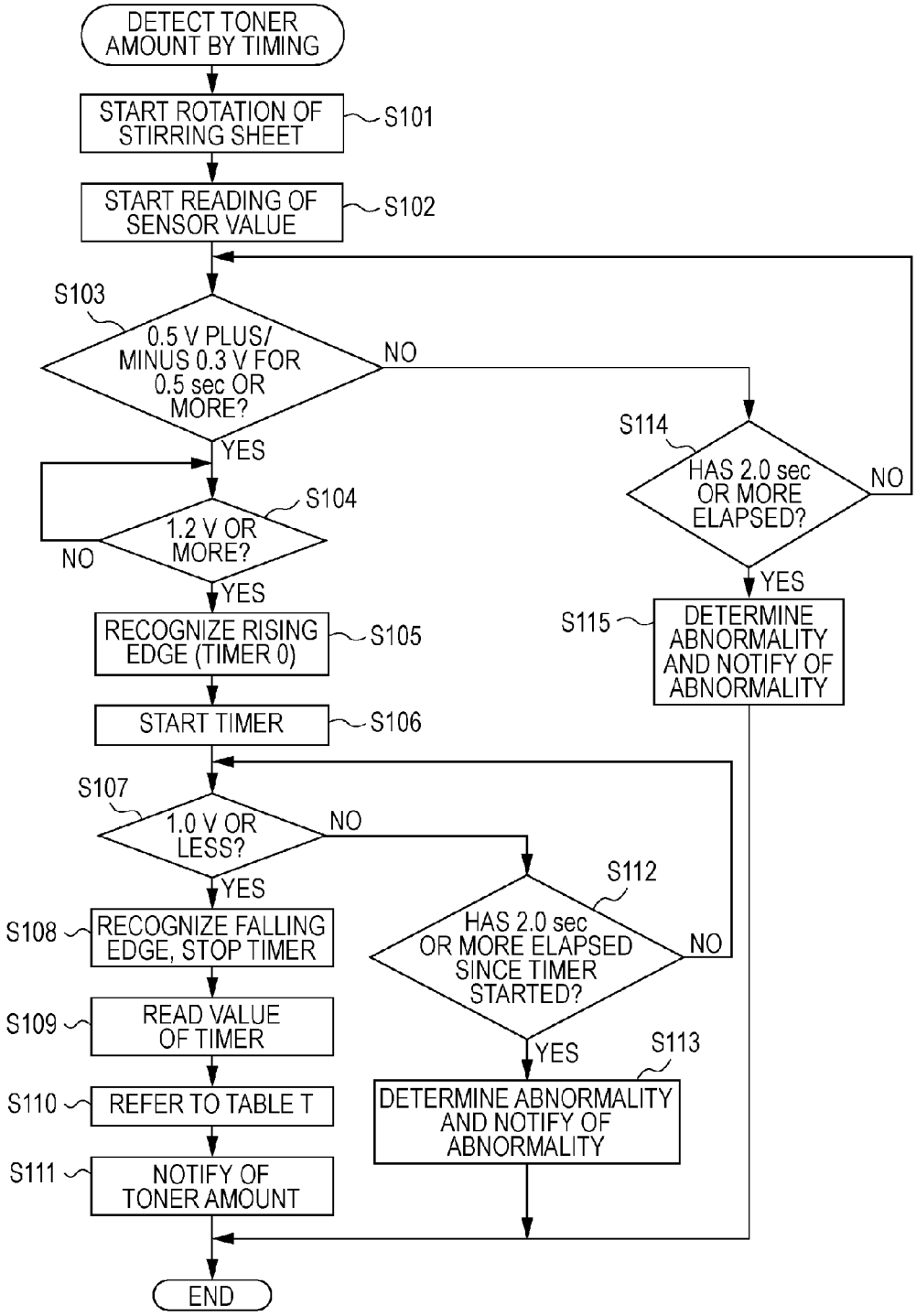
[FIG. 6]

Next, a flow of the toner remaining amount detection in the present embodiment will be described with reference a sequence flowchart in FIG. 6. The process of the flow is performed by the CPU 40. However, it is not limited to this, and for example, if an application specific integrated circuit (ASIC) is mounted in the image forming apparatus, the ASIC may have function of some steps.

First, the stirring sheet 34 is rotated (S101). The A/D input port of the CPU 40 is monitored and sensor value begins to be read (S102). To detect an initial value when no pressure is applied to the optical sensor unit 508, whether or not a voltage of 0.5 V plus/minus 0.3 V continues for 0.5 sec or more is monitored (S103). The cycle of the stirring sheet 34 is about 1 sec in the present embodiment. If the voltage of 0.5 V plus/minus 0.3 V does not continue for 0.5 sec or more and 2.0 sec or more has elapsed since the beginning of reading (S114), it is determined that the optical sensor unit 508 is abnormal and the video controller 42 is notified that the optical sensor unit 508 is abnormal (S115). If the voltage of 0.5 V plus/minus 0.3 V continues for 0.5 sec or more in S103, normal operation is determined and the A/D port of the CPU 40 is monitored. When the A/D port becomes 1.2 V or more (S104), it is determined to be a rising edge of the sensor signal (S105). A timer for measuring the time width is started (S106). Next, the A/D input port of the CPU 40 is monitored. When the A/D input port becomes 1.0 V or less (S107), it is recognized to be a falling edge of the signal (S107) and the timer is stopped (S108). The reason why the threshold of the rising edge is 1.2 V and the threshold of the falling edge is 1.0 V is to set a hysteresis and prevent malfunction due to noise.

Next, the value of the timer is read (S109), the table T is referred to, and a corresponding value is detected (S110). Then, the amount of remaining toner corresponding to the detected value is notified to the video controller 42 (S111). If 2.0 sec or more has elapsed since the timer was started in S107 (S112), abnormality is determined and the abnormality is notified to the video controller 42 (S113).

In this way, the amounts of remaining toner are detected sequentially by using the time width in which the optical sensor unit 508 detects pressure.

Here, it is described that the stirring sheet 34 is rotated during the toner remaining amount detection sequence. However, if the stirring sheet 34 is rotated during an image forming operation or the like, the amount of remaining toner can be detected. The stirring sheet 34 may be rotated several times before the amount of remaining toner is detected, and the detection of the amount of remaining toner may be started after the rotation of the stirring sheet 34 becomes stable. Although the amount of remaining toner is detected on the basis of one measurement result, it is possible to further improve measurement accuracy by measuring the amount of remaining toner a plurality of times and determining the amount of remaining toner from the average value of a plurality of measurement results. The threshold of the rising edge, the threshold of the falling edge, and the value of the timer which are defined here are examples in the present embodiment. The values of these are determined by collectively taking into account the arrangement of the optical sensor unit 508, the rotation speed of the stirring sheet 34, the circuit constant, the characteristics of the light-emitting device and the photo detector, the thicknesses of the PET film 505 and the double-sided tape 504, and the like, so that the values are not limited to those described above.

As described above, the amount of remaining toner is determined on the basis of the time period from when the toner pressed by the stirring sheet 34 reaches the detection surface of the optical sensor unit 508 to when the front edge of the stirring sheet 34 passes over the detection surface of the optical sensor unit 508. Thereby the amount of remaining toner can be detected sequentially from when the toner is full to when the toner is empty. The optical sensor unit 508 is used, so that it is possible to simplify the detection circuit as well as to reduce the detection time because of high response speed. Further, the light-emitting device and the photo detector are provided in the image forming apparatus main body, so that it is possible to simplify the configuration of the developing unit, which is a replaceable part. According to the present embodiment, the input voltage of the A/D port of the CPU 40 is detected. However, the port may be digitalized by forming a voltage detection circuit by a comparator or the like, so that a time may be detected by the digital port. In the present embodiment, the double-sided tape 504 is used as a spacer. The spacers can also be formed by raising the developing unit inner wall 501 around the light guide pair. In this case, the sheet needs to be attached by thermal adhesion, adhesive, the double-sided tape 504, or the like.

Although, in the present embodiment, the PET film 505 is used as a partition member, it is not limited to this, and a polyester film or a polyurethane sheet can be used to have the same effect as that of the PET film 505. The partition member only has to bend so that the partition member blocks at least a part of the light path for detecting the amount of developer when the partition member is pressed by the stirring sheet 34. However, the amount of deformation of the partition member is desired not to change over time.

Optical fibers that transmit light can have the same effect as that of the light guides 502 and 503 described in the present embodiment. When the optical fibers are used, a semiconductor laser may be used as the light-emitting device.

In the present embodiment, a configuration in which pressure is applied by the stirring sheet 34 is described. However, if the stirring sheet 34 is too flexible to press sufficiently the detection surface of the optical sensor unit 508, a pressing portion 341 for pressing a wall surface in the circumferential direction in the container may be added at a portion near the optical sensor unit 508 in the axis direction of the stirring sheet 34. The pressing portion 341 only has to be flexible. The pressing portion 341 may be formed integrally with the stirring sheet 34 or attached to the stirring sheet 34 as a separate member.

Second Embodiment

In the first embodiment, the amount of remaining toner is detected on the basis of the time period from when the toner pressed by the stirring sheet 34 reaches the detection surface of the optical sensor unit 508 to when the front edge of the stirring sheet 34 passes over the detection surface of the optical sensor unit 508. On the other hand, in the present embodiment, the amount of remaining toner is detected by detecting a voltage value converted from a received light quantity corresponding to a pressure detected by the optical sensor unit 508.

First, a "color laser printer" according to the present embodiment will be described. The configurations shown in FIGS. 1, 2A, 2B, 2C, and 3 and the circuit diagram shown in FIG. 4, which are described in the first embodiment, are also applied to the present embodiment. The same components as those in the first embodiment are given the same reference numerals and the detailed description thereof will be omitted to avoid redundancy. Here, in the present embodiment, the power supply voltage in the circuit diagram shown in FIG. 4 is (DC) 5.0 V.

Figure 7A:
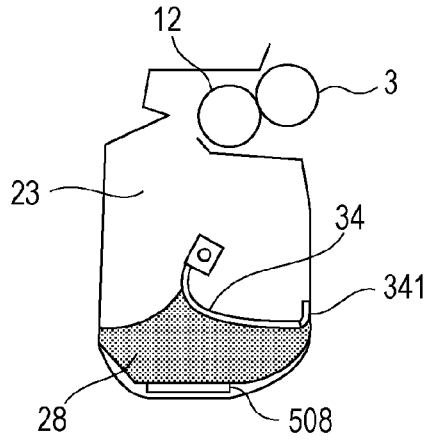
[FIG. 7A]
Figure 7B:
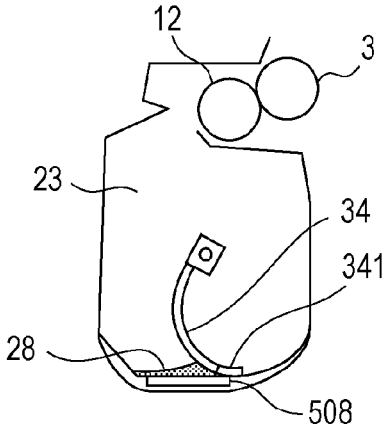
[FIG. 7B]

FIG. 7A is a cross-sectional view of the developing unit when there is a large amount of remaining toner. FIG. 7B is a cross-sectional view of the developing unit when there is a small amount of remaining toner.

A difference from the first embodiment is that a pressing portion 341 for pressing a wall surface in the circumferential direction in the container is added at a portion near the optical sensor unit 508 in the axis direction of the stirring sheet 34.

When there is a large amount of remaining toner as shown in FIG. 7A, the stirring sheet 34 rotates inside the toner container 23 without coming into contact with the detection surface of the optical sensor unit 508. On the other hand, when there is a small amount of remaining toner as shown in FIG. 7B, the stirring sheet 34 rotates inside the toner container 23 while being in contact with the detection surface of the optical sensor unit 508.

Figure 7C:
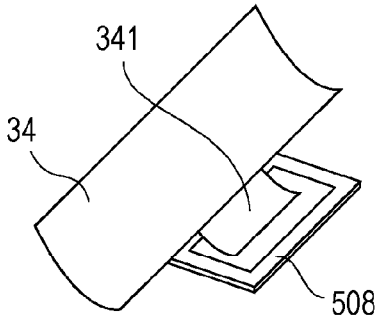
[FIG. 7C]

FIG. 7C is a perspective view showing a positional relationship between the pressing portion 341 and the optical sensor unit 508. The width in the longitudinal direction of the pressing portion 341 is within the detection surface inside the spacer of the optical sensor unit 508.

Figure 8A:
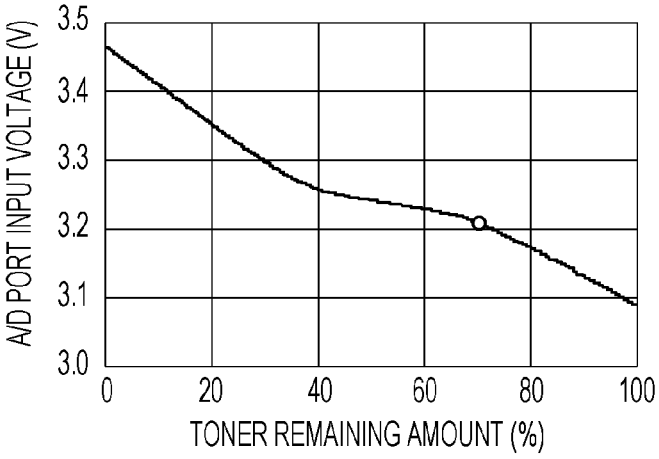
[FIG. 8A]
Figure 8B:
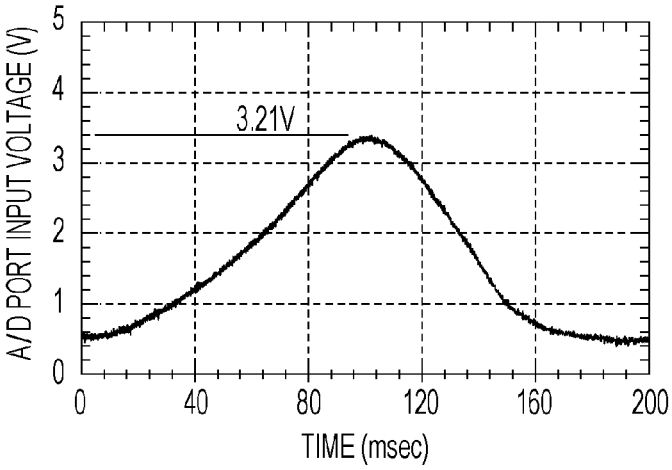
[FIG. 8B]

FIG. 8A a characteristic graph of the amount of remaining toner and a detected voltage when the pressing portion 341 of the stirring sheet 34 applies a largest pressure to the detection surface of the optical sensor unit 508 while the pressing portion 341 is passing over the optical sensor unit 508. FIG. 8B is waveform data when the amount of remaining toner is 70%. The detected voltage when the light is most blocked by the stirring sheet 34, the pressing portion 341, and the toner pressed by the stirring sheet 34 and the pressing portion 341 is about 3.21 V. FIG. 8C is a table M that indicates a relationship between the detected voltage and the amount of remaining toner.

Figure 9:
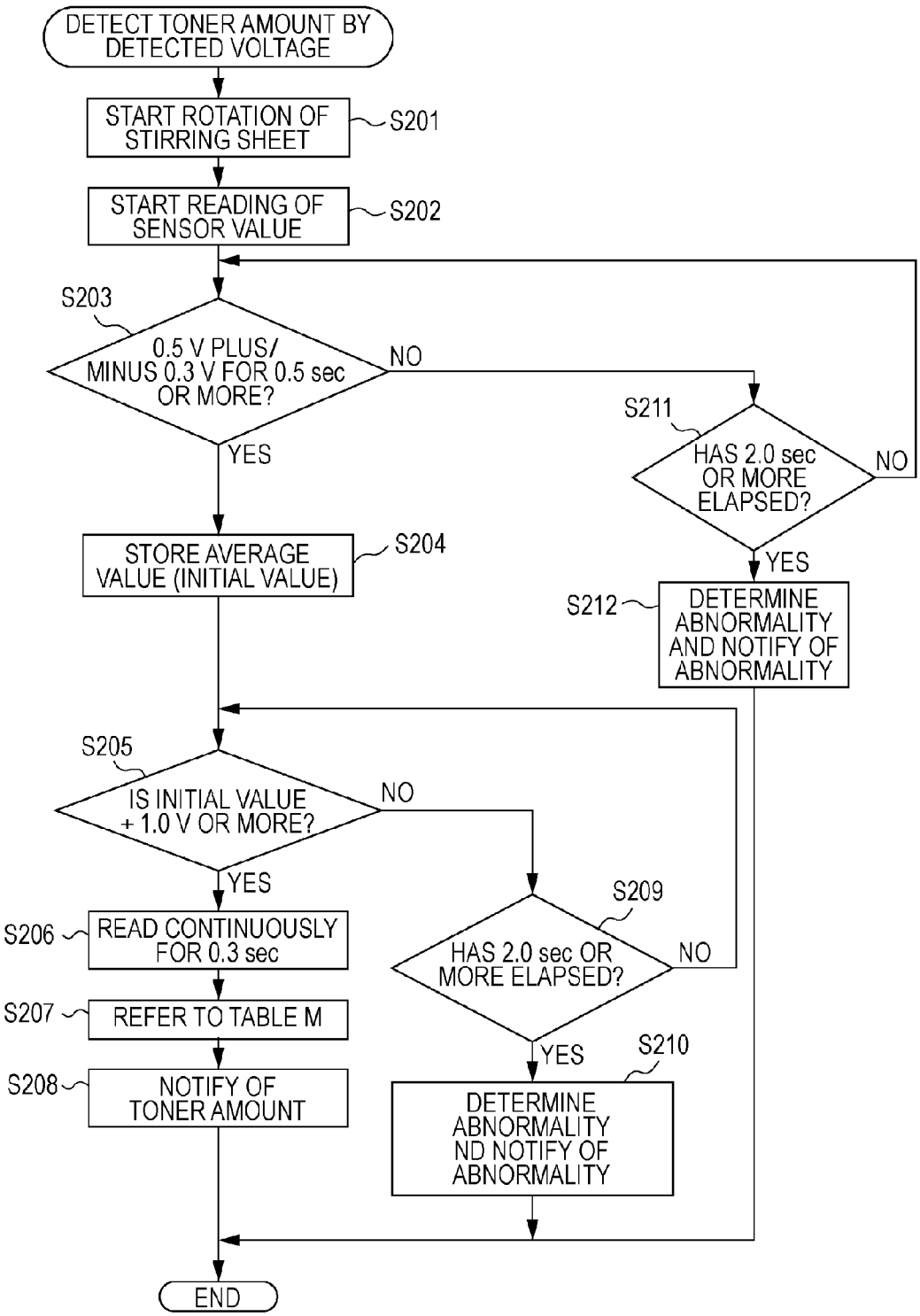
[FIG. 9]

Next, a flow of the toner remaining amount detection in the present embodiment will be described with reference a sequence flowchart in FIG. 9. The process of the flow is performed by the CPU 40. However, it is not limited to this, and for example, if an application specific integrated circuit (ASIC) is mounted in the image forming apparatus, the ASIC may have function of some steps.

Next, a flow of the toner remaining amount detection in the present embodiment will be described with reference a sequence flowchart in FIG. 8.

First, the stirring sheet 34 is rotated (S201). The A/D input port of the CPU 40 is monitored and sensor value begins to be read (S202). To detect an initial value when no pressure is applied to the optical sensor unit 508, whether or not a voltage of 0.5 V plus/minus 0.3 V continues for 0.5 sec or more is monitored (S203). The cycle of the stirring sheet 34 is about 1 sec in the present embodiment. If the voltage of 0.5 V plus/minus 0.3 V does not continue for 0.5 sec or more and 2.0 sec or more has elapsed since the beginning of reading (S211), it is determined that the optical sensor unit 508 is abnormal and the video controller 42 is notified that the optical sensor unit 508 is abnormal (S212). When the voltage of 0.5 V plus/minus 0.3 V continues for 0.5 sec or more, the average value during this time period is stored as an initial value (S204). To detect that pressure begins to be applied to the optical sensor unit 508, whether or not the initial value is +1.0 V or more is monitored (S205). If the initial value does not become +1.0 V or more even when 2.0 sec or more has elapsed (S209), abnormality is determined and the abnormality is notified to the video controller 42 (S210). If the initial value becomes +1.0 V or more while the voltage is monitored, it is recognized that pressure begins to be applied to the optical sensor unit 508, continuous reading is started, and values read in 0.3 sec are stored (S206). The largest voltage value is obtained from the stored values, the table M is referred to, and a value corresponding to the largest voltage value is detected (S207).

Then, the amount of remaining toner corresponding to the detected value is notified to the video controller 42 (S208).

The pressing portion 341 only has to be flexible. The pressing portion 341 may be formed integrally with the stirring sheet 34 or attached to the stirring sheet 34 as a separate member.

In this way, the amounts of remaining toner are detected sequentially by using an output voltage when the optical sensor unit 508 detects the largest pressure.

Third Embodiment

First, a "color laser printer" according to the present embodiment will be described. The configurations shown in FIGS. 1, 2A, 2B, 2C, 3, 7A, 7B, and 7C, which are described in the first and the second embodiments, are also applied to the present embodiment. The same components as those in the first and the second embodiments are given the same reference numerals and the detailed description thereof will be omitted to avoid redundancy.

Figure 10A:
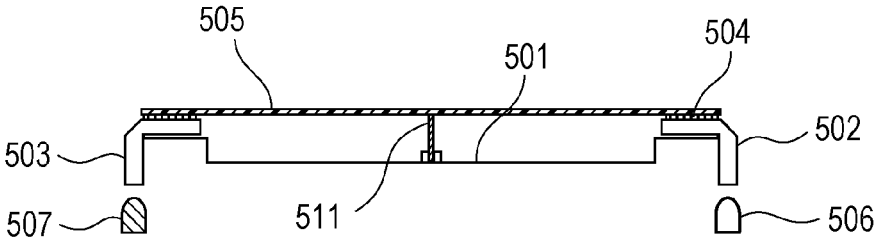
[FIG. 10A]
Figure 10B:
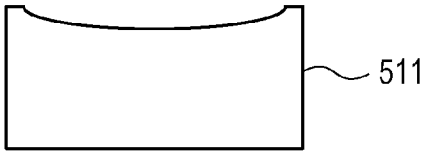
[FIG. 10B]

FIG. 10A is a cross-sectional view showing a configuration of the present embodiment. Reference numeral 511 denotes a light blocking plate (light blocking member). The material of the light blocking plate 511 is a black plastic plate with a thickness of 0.5 mm FIG. 10B is an outside view of the light blocking plate 511. The light blocking plate 511 is attached and fixed to the developing unit wall 501. A light path for detecting the amount of developer is formed in a space between the light blocking plate 511 and the PET film 505. The light blocking plate 511 has a U-shape that blocks the light path other than a range in which the PET film 505 moves. In other words, the PET film 505 can bend so that the PET film 505 blocks at least a part of the light path for detecting the amount of developer, which is not blocked by the light blocking plate 511.

Figure 11:
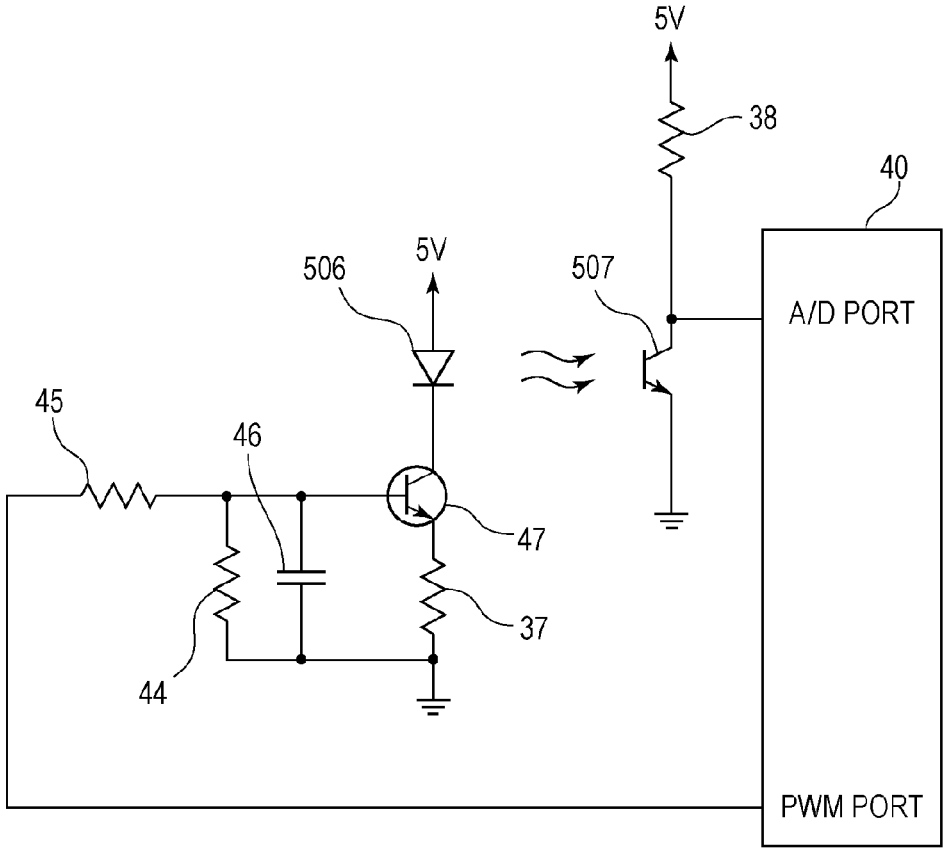
[FIG. 11]

FIG. 11 is a circuit diagram according to the present embodiment. The circuit has a configuration that can automatically adjust the light quantity of the LED 506. First, components that are added to the circuit of FIG. 4 will be described. Reference numeral 44 denotes a pull-down resistor. Reference numeral 45 denotes a base resistance. Reference numeral 46 denotes a smoothing capacitor. Reference numeral 47 denotes a transistor.

Here, also in the present embodiment, the power supply voltage is (DC) 5.0 V. The CPU 40 outputs a pulse from the PWM port and sets the light quantity of the LED 506 according to a time ratio (hereinafter referred to as DUTY) of a high level and a low level of the pulse. The pulse is integrated by the base resistance 45 and the smoothing capacitor 46 and converted into a substantial direct current, so that the base current of the transistor 47 is changed. Therefore, when the DUTY is large, the base current is large, the voltage of the fixed resistor 37 which is a current limiting resistor is high, and the current of the LED 506 is large. On the other hand, when the DUTY is small, the base current is small, the voltage of the fixed resistor 37 which is a current limiting resistor is low, and the current of the LED 506 is small.

Figure 12:
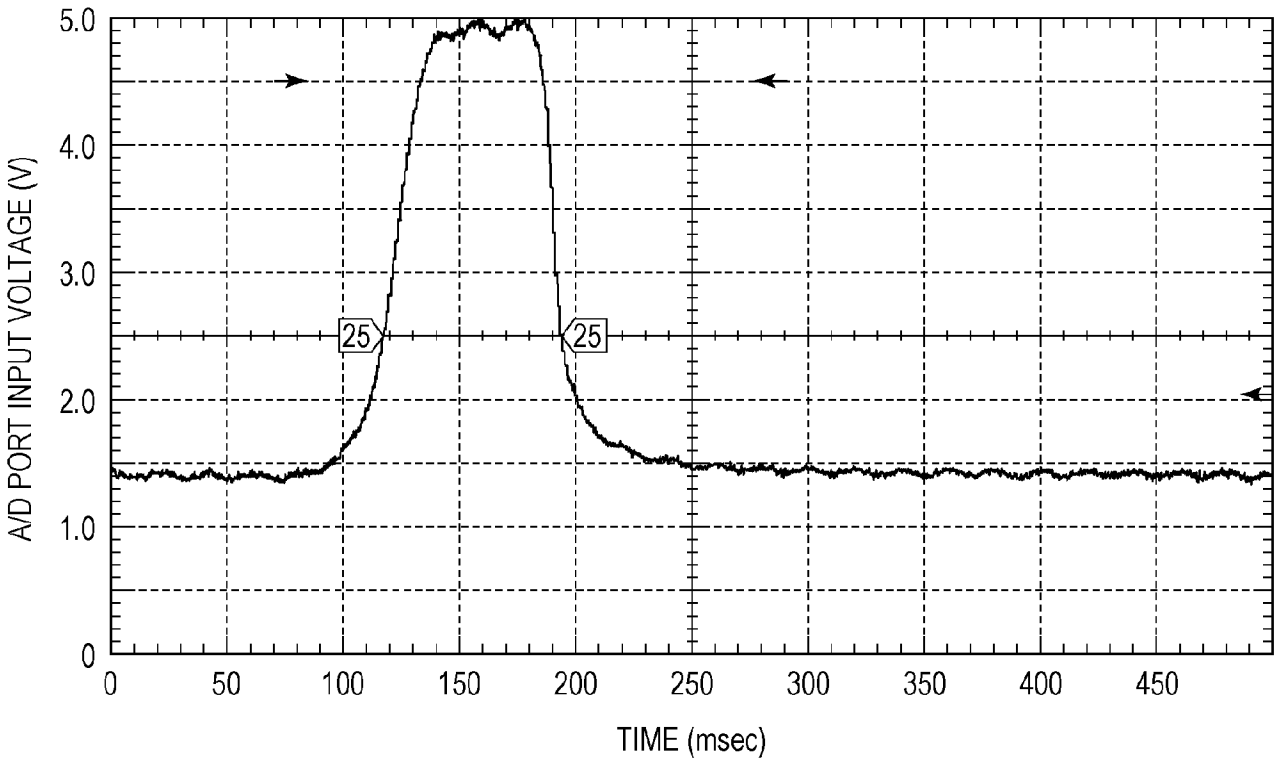
[FIG. 12]

FIG. 12 is a waveform when the amount of remaining toner is 0% in the present embodiment. It is understood that the effect of noise overlapping the signal is small because the change of the waveform is sharper than that in FIG. 5B.

Figure 13A:
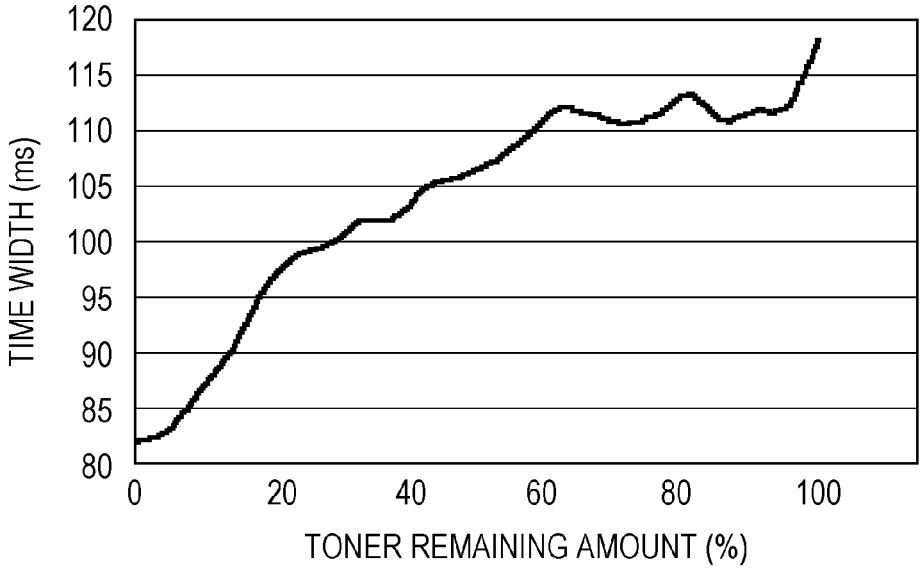
[FIG. 13A]

FIG. 13A is a characteristic graph of the time width with respect to the amount of remaining toner. FIG. 13B is a table K. The amounts of remaining toner between the values in the table are calculated by a known linear interpolation. Here, the calculated time is a value in the present embodiment, so that when the condition changes, the calculated time also changes. The same is true for the values in the table for calculating the amount of remaining toner.

Figure 14:
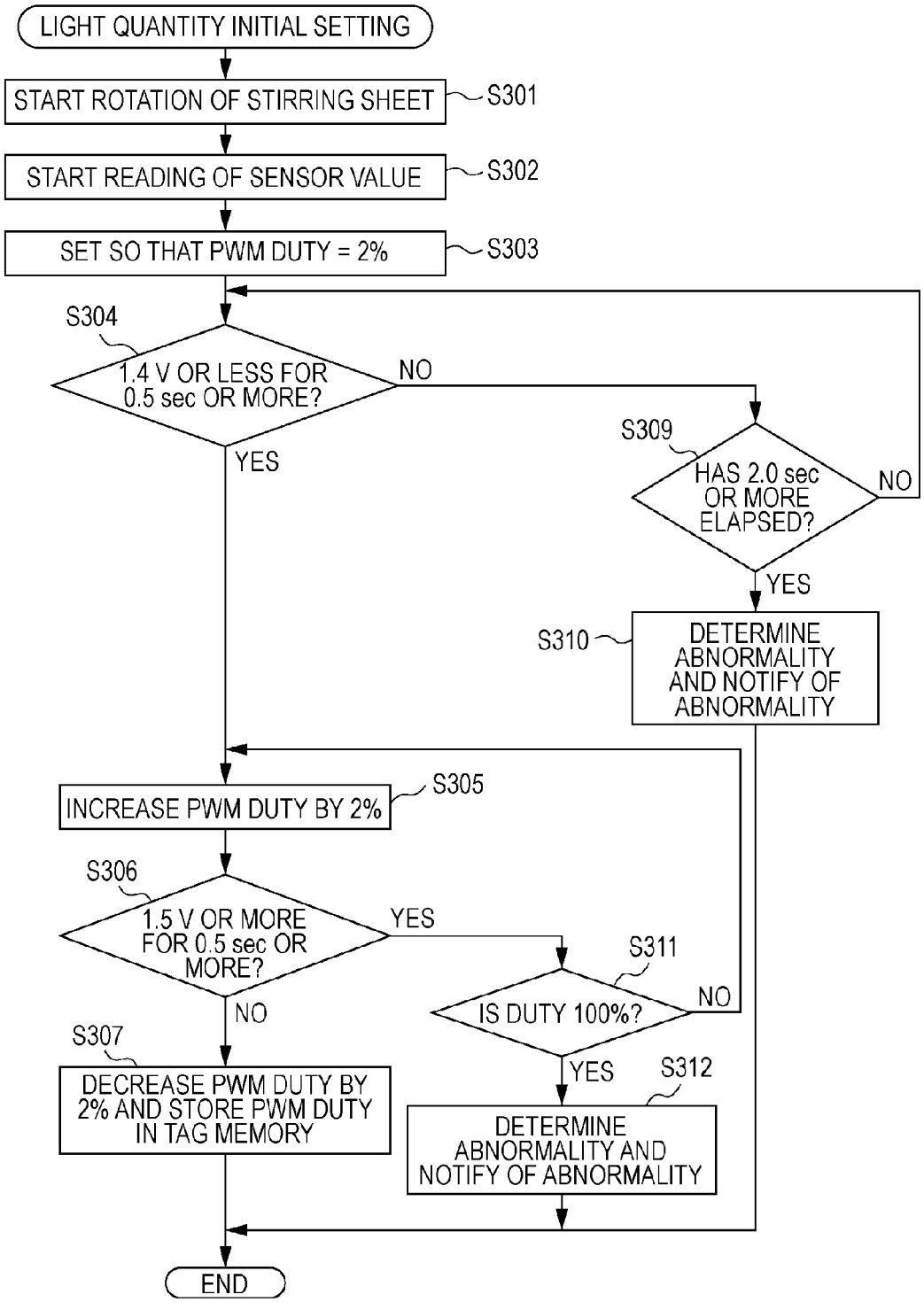
[FIG. 14]

FIG. 14 is a sequence flowchart of the CPU 40 for setting the light quantity of the LED 506 when a new process cartridge is detected. First, the stirring sheet begins to be rotated (S301). Next, the value of the A/D input port begins to be read (S302). The output DUTY of the PWM port is set to 2% (S303). It is checked that the A/D input port is 1.4 V or less for 0.5 sec or more (S304). If a value greater than 1.4 V continues for 2.0 sec or more, abnormality is determined and the abnormality is notified to the video controller 42 (S310). Because, also in the present embodiment, the cycle (stirring cycle) of the stirring sheet 34 is about 1 sec. When the voltage is 1.4 V or less for 0.5 sec or more in S304, the PWM DUTY is increased by 2% to slightly increase the light quantity (S305). Also in this state, it is checked whether or not the A/D input port is 1.4 V or less for 0.5 sec or more (S306). Similarly, each time it is checked that the A/D input port is 1.4 V or less for 0.5 sec or more, the PWM DUTY is increased by 2% to increase the light quantity and a PWM DUTY at which the voltage is greater than 1.4 V is detected. If the PWM DUTY becomes 100% before the PWM DUTY at which the voltage is greater than 1.4 V is detected (S311), abnormality is determined and the abnormality is notified to the video controller 42 (S312). When the PWM DUTY at which the voltage is greater than 1.4 V is detected in S306, the value of the PWM DUTY is decreased by 2% and the decreased value is stored in a tag memory of the process cartridge (S307).

Therefore, if the PWM DUTY stored in the tag memory is set, the voltage is lower than 1.4 V when the stirring sheet 34 does not press the PET film 505 via the toner.

Figure 15:
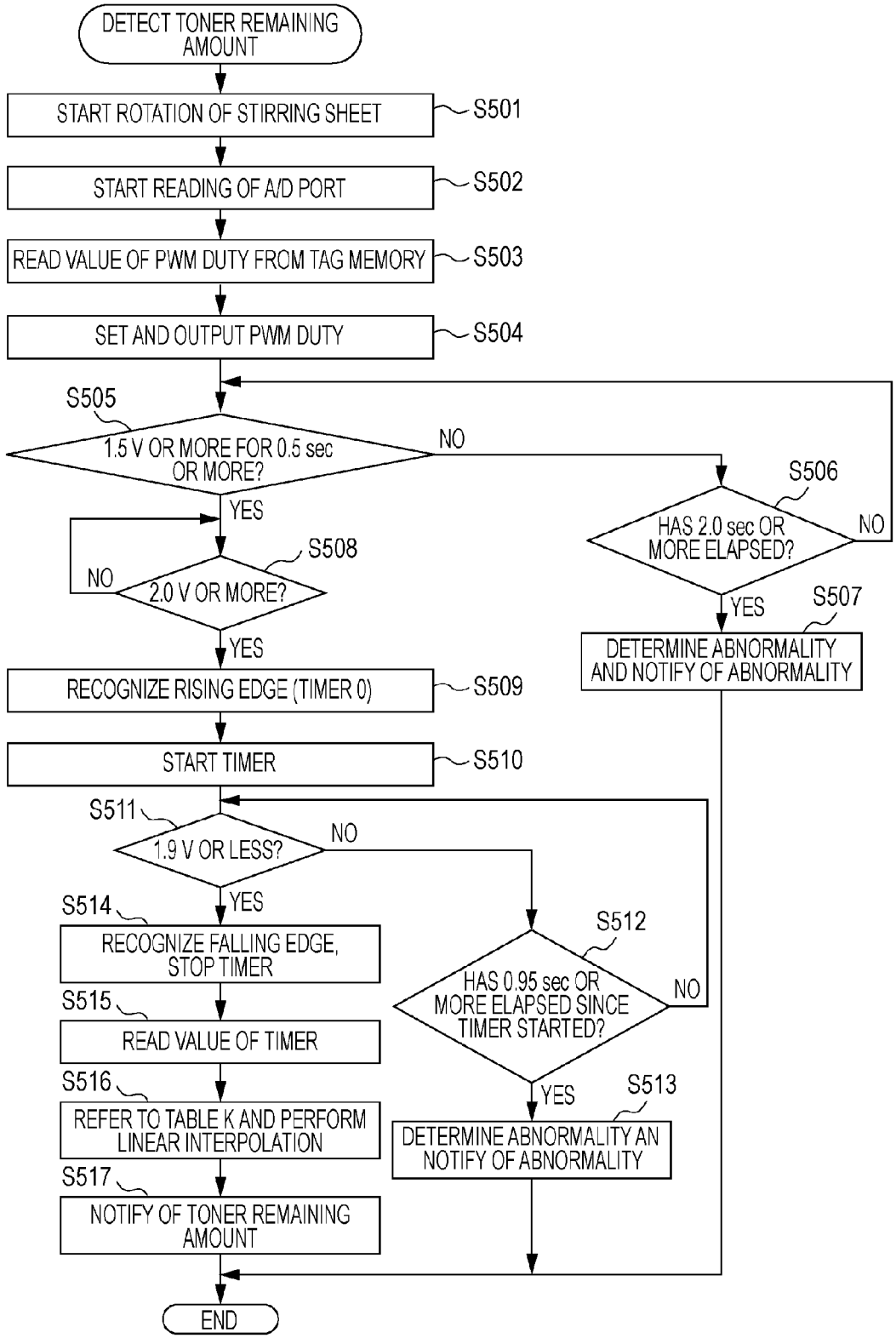
[FIG. 15]

FIG. 15 is a sequence flowchart of the toner remaining amount detection. First, the stirring sheet begins to be rotated (S501). Next, the value of the A/D input port begins to be read (S502). The value of the PWM DUTY is read from the tag memory of the process cartridge and the output DUTY of the PWM port is set to the read value (S504). It is checked that the A/D input port is 1.5 V or more for 0.5 sec or more (S505). If a value greater than 1.5 V continues for 2.0 sec or more (S506), abnormality is determined and the abnormality is notified to the video controller 42 (S507). If the A/D input port is 1.5 V or less for 0.5 sec or more in S505, when the value of the A/D input port becomes 2.0 V or more (S508), a rising edge is recognized (S509), and then the timer is started (S510). Thereafter, when the value of the A/D input port becomes 1.9 V or less, a falling edge is recognized (S511). The reason why the rising edge is defined as 2.0 V and the falling edge is detected at 1.9 V is to set a hysteresis of 0.1 V and prevent chattering due to noise. If 0.95 sec or more has elapsed in S512 since the timer was started, abnormality is determined and the abnormality is notified to the video controller 42 (S513). The reason why 0.95 sec is used is because the cycle of the stirring sheet 34 is 1 sec and there is no pulse width of 50 msec or less in the present embodiment. If the falling edge is recognized in S511, the timer is stopped (S514). Then, the value of the timer is read (S515), the table K is referred to (S516), and the amount of remaining toner is calculated by linear interpolation and notified (S517).

The advantage of the present embodiment is that, even when the pressure by which the stirring sheet 34 presses the PET film 505 via the toner is small, the light path is blocked, so that the time period in which the waveform changes is small, so that the effect of noise superimposed on the signal is small, and thus it is possible to further improve the accuracy of detecting the amount of remaining toner.

Fourth Embodiment

In the present embodiment, the configuration of the optical sensor unit 508 is different from that of the third embodiment.

Figure 16A:
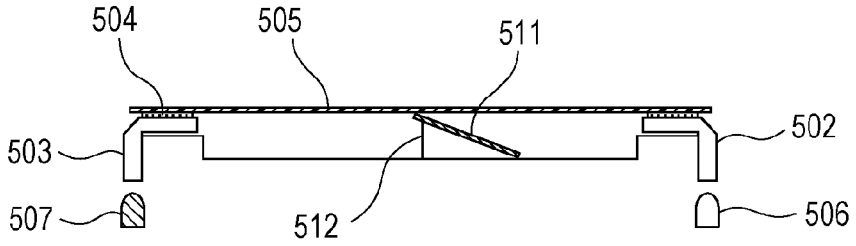
[FIG. 16A]
Figure 16B:
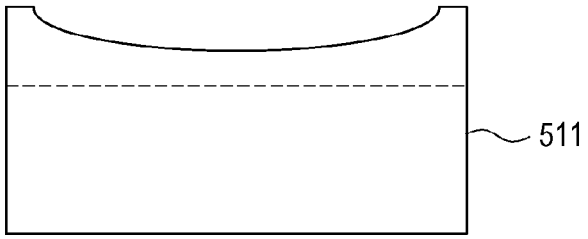
[FIG. 16B]
Figure 16C:
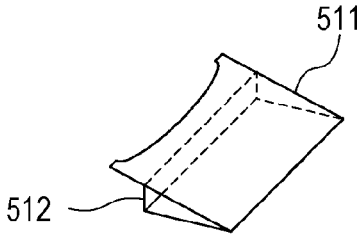
[FIG. 16C]

FIG. 16A is a cross-sectional view showing a configuration of the present embodiment. The difference from the third embodiment is that the light blocking plate 511 is attached and fixed to a light blocking plate fixing platform 512 at an angle of about 30 degrees with respect to the PET film 505. Here, the light blocking plate 511 is a black PET film with a thickness of 200 micrometer. FIG. 16B is an outside view of the light blocking plate 511 as seen from the light guide 502. The light blocking plate 511 has a shape that blocks the light path other than a range in which the PET film 505 moves. FIG. 16C is a perspective view of the light blocking plate 511 and the light blocking plate fixing platform 512. In the present embodiment, the circuit, the characteristic graph of the time width with respect to the amount of remaining toner, and the table K are the same as those shown in FIG. 11, 13A, and 13B respectively. The sequence flowcharts of the present embodiment are the same as those shown in FIGS. 14 and 15 in the third embodiment. The description thereof will be omitted to avoid redundancy.

The configuration described above has advantages as described below. The distance between the PET film 505 and the light blocking plate 511 may be short due to the tolerance or the like. In this case, when the stirring sheet 34 presses the PET film 505 via the toner, not only the light path between the light blocking plate 511 and the PET film 505 is blocked, but also a force pressing the light blocking plate 511 is applied. At this time, the light blocking plate 511 disperses the bending pressure toward the light blocking plate fixing platform 512, so that no extra stress is applied to the PET film 505 and the light blocking plate 511. Therefore, the dimensional tolerance of components of the optical sensor unit 508 can be alleviated, so that an accurate detection of the amount of remaining toner can be realized even when using low cost components.

Fifth Embodiment

In the fourth embodiment, the light blocking plate 511 is disposed at the center between the light guide 502 and the light guide 503. However, in the present embodiment, the light blocking plate 511 is disposed at a position shifted from the center between the light guide 502 and the light guide 503.

Figure 17A:
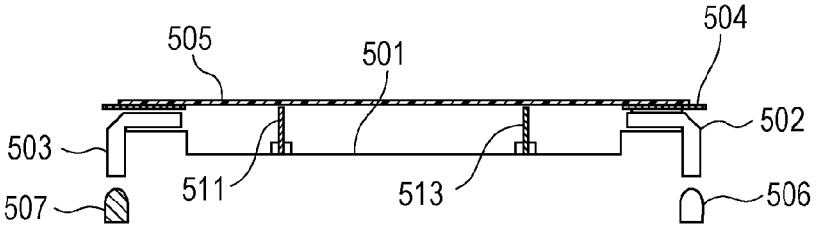
[FIG. 17A]
Figure 17B:
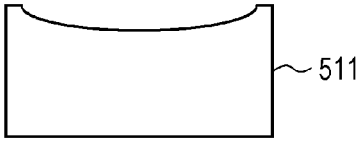
[FIG. 17B]

FIG. 17A is a cross-sectional view of the optical sensor unit of the fifth embodiment. FIG. 17B is an outside view of the light blocking plate of the fifth embodiment. FIGS. 17C, 17D, 17E, and 17F are diagrams for explaining a mechanism of the fifth embodiment.

FIG. 17A is a cross-sectional view showing a configuration of the present embodiment. FIG. 17B is an outside view of the light blocking plate 511. The light blocking plate 513 has the same shape as that of the light blocking plate 511. The light blocking plates 511 and 513 are attached and fixed to the developing unit wall 501. The light blocking plate 511 has a U-shape that forms a space smaller than a range in which the PET film 505 moves. Here, the light blocking plates 511 and 513 are black PET films with a thickness of 200 micrometer.

When no load is applied to the PET film 505, a light path is formed by the light blocking plates 511 and 513 and the PET film 505.

As shown in FIG. 17A, the light blocking plate 511 is disposed near the ¼ position between the light guide 502 and the light guide 503 and the light blocking plate 513 is disposed near the ¾ position between the light guide 502 and the light guide 503.

Figure 17C:
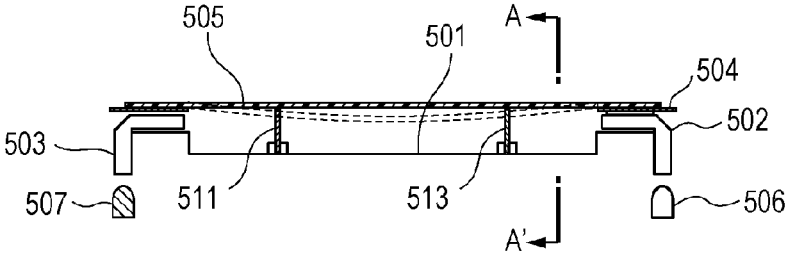
[FIG. 17C]
Figure 17D:
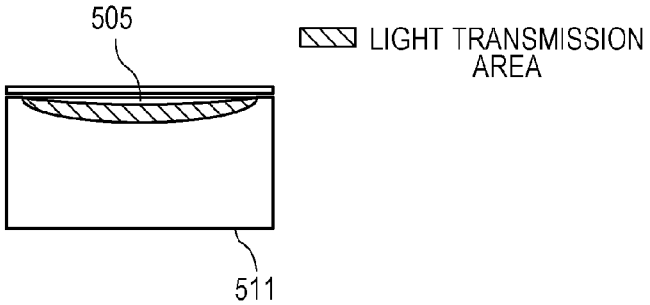
[FIG. 17D]
Figure 17E:
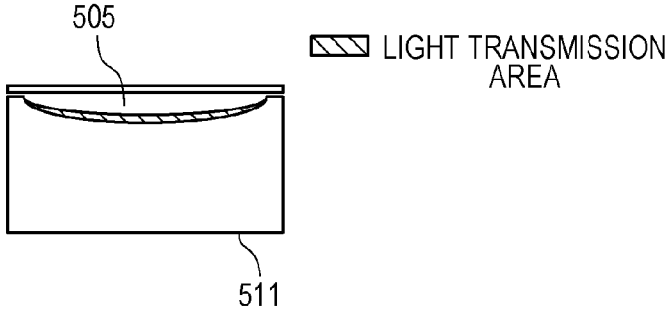
[FIG. 17E]
Figure 17F:
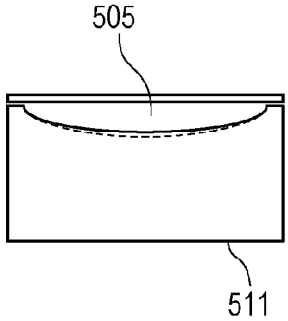
[FIG. 17F]

FIG. 17C is a cross-sectional view for explaining a mechanism of the present embodiment. States in which the stirring sheet 34 presses the PET film 505 via the toner are shown by dashed lines. FIGS. 17D, 17E, and 17F are cross-sectional views taken along the line A-A' in FIG. 17C. Here, the shaded areas enclosed by the PET film 505 and the upper side of the light blocking plate 511 in FIGS. 17D and 17E are light transmission areas. FIG. 17D shows a state in which the stirring sheet 34 does not press the PET film 505 via the toner. FIG. 17E shows a state in which the stirring sheet 34 presses halfway the PET film 505. FIG. 17F shows a state in which the stirring sheet 34 fully presses the PET film 505. At this time, the center of the PET film 505 bends more than the U-shaped portion of the light blocking plate 505, so that the PET film 505 also blocks the light path as shown by the dashed line in FIG. 17F. In this state, there is substantially no transmitting light. Therefore, according to the waveform shown FIG. 12, when the light path is blocked, the input voltage is 5 V which is the power supply voltage, so that the effect of noise superimposed on the signal is further reduced, and thus it is possible to further improve the accuracy of detecting the amount of remaining toner.

In the present embodiment, the circuit, the characteristic graph of the time width with respect to the amount of remaining toner, and the table K are the same as those shown in FIG. 11, 13A, and 13B respectively. The sequence flowcharts of the present embodiment are the same as those shown in FIGS. 14 and 15 in the third embodiment. The description thereof will be omitted to avoid redundancy.

In the present embodiment, it is described that there are two light blocking plates 511 and 513. However, even if only one of the light blocking plates is used, the same effect can be expected.

Sixth Embodiment

Figure 18A:
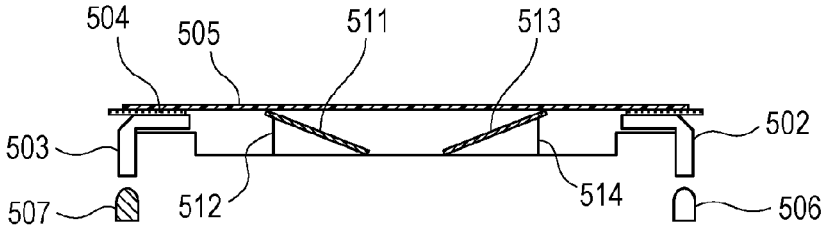
[FIG. 18A]
Figure 18B:
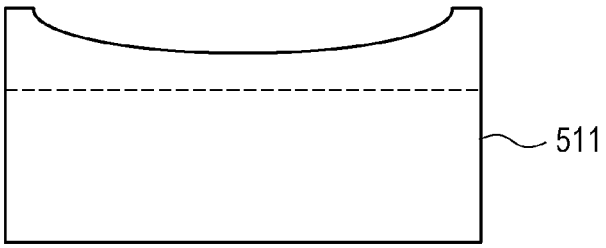
[FIG. 18B]
Figure 18C:
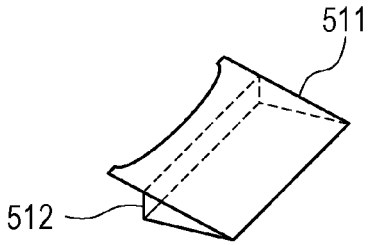
[FIG. 18C]

FIG. 18A is a cross-sectional view of the optical sensor unit of the sixth embodiment. FIG. 18B and 18C are outside views of the light blocking plate of the sixth embodiment.

FIG. 18A is a cross-sectional view showing a configuration of the present embodiment. The light blocking plate 511 is attached and fixed to the light blocking plate fixing platform 512 at an angle of about 30 degrees with respect to the PET film 505. Also, the light blocking plate 513 is attached and fixed to the light blocking plate fixing platform 514 at an angle of about −30 degrees with respect to the PET film 505. Here, the light blocking plates 511 and 513 are black PET films with a thickness of 200 micrometer. FIG. 18B is an outside view of the light blocking plate 511. The light blocking plate 513 has the same shape as that of the light blocking plate 511. FIG. 18C is a perspective view showing a relationship between the light blocking plate 511 and the light blocking plate fixing platform 512.

In the configuration described above, when the stirring sheet 34 presses the PET film 505 via the toner, not only the light path between the light blocking plate 511 and the PET film 505 is blocked, but also a force pressing the light blocking plate 511 is applied. At this time, the light blocking plate 511 disperses the bending pressure toward the light blocking plate fixing platform 512, so that no extra stress is applied to the PET film 505 and the light blocking plate 511. The light path is also blocked at the center of the PET film 505. In this state, there is substantially no transmitting light. Therefore, according to the waveform shown in FIG. 12, when the light path is blocked, the input voltage is 5 V which is the power supply voltage, so that the effect of noise superimposed on the signal is further reduced, and thus it is possible to further improve the accuracy of detecting the amount of remaining toner. By the configuration and action described above, the dimensional tolerance of components of the optical sensor unit 508 can be alleviated, so that an accurate detection of the amount of remaining toner can be realized even when using low cost components.

In the present embodiment, it is described that there are two light blocking plates 511 and 513. However, even if only one of the light blocking plates is used, the same effect can be expected. Also in the present embodiment, the circuit, the characteristic graph of the time width with respect to the amount of remaining toner, and the table K are the same as those shown in FIG. 11, 13A, and 13B respectively. The sequence flowcharts of the present embodiment are the same as those shown in FIGS. 14 and 15 in the third embodiment. The description thereof will be omitted to avoid redundancy.

In the first to the sixth embodiments, for ease of understanding, it is described that the table is referred to for each detection. However, if an average value of data of a plurality of detecting actions is calculated and thereafter the table is referred to, it can be expected to further improve the detection accuracy.

In the first to the fourth embodiments, an example in which the developing unit is integrally formed is described. However, the present invention can be applied to a toner container of a supply system, in which the developing roller 3 and the toner container 23 are separately provided, by providing the optical sensor unit 508 inside the toner container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-092366, filed Apr. 18, 2011, which is hereby incorporated by reference herein in its entirety.

REFERENCE SIGNS LIST

1Y, 1M, 1C, 1K Photosensitive drum
3Y, 3M, 3C, 3K Developing roller
5 Process cartridge
23Y, 23M, 23C, 23K Toner container
28 Toner
101 Main body
34 Stirring sheet
40 One-chip microcomputer (CPU)
501 Developing unit wall
505 PET film
506 LED
507 Phototransistor
508 Optical sensor unit
511 Light blocking plate
513 Light blocking plate
515 First space

The invention claimed is:

1. A developing apparatus comprising:

a developer containing portion configured to contain developer;

a developer bearing member configured to bear the developer and develop an electrostatic latent image;

a flexible stirring member configured to stir the developer in the developer containing portion; and a partition member which is disposed to separate the developer containing portion from a space adjacent to the developer containing portion and which is arranged to bend to block at least a part of a light path when being pressed by the stirring member via the developer, the light path being formed in the space and used to detect an amount of the developer.

2. The developing apparatus according to claim 1, wherein the stirring member has a length by which the stifling member can come into contact with the partition member when stifling the developer in the developer containing portion.

3. The developing apparatus according to claim 1, further comprising:

a light blocking portion arranged in the space to block a part of the light path, wherein the partition member bends so that the partition member blocks at least a part of the light path which is not blocked by the light blocking portion.

4. A process cartridge that can be attached to and detached from an image forming apparatus main body, the process cartridge comprising:

the developing apparatus according to claims 1; and an image bearing member on which a developer image is formed by the developing apparatus.

5. An image forming apparatus comprising:

the developing apparatus according to claims 1;

an image bearing member on which a developer image is formed by the developing apparatus; and a detection unit configured to include a light-emitting device and a photo detector that forms the light path between the photo detector and the light-emitting device and detect an amount of the developer in the developer containing portion on the basis of an output from the photo detector when the partition member is pressed by the stifling member.

6. The developing apparatus according to claim 1, wherein the stifling member passes over the partition member when stifling the developer in the developer containing portion.

* * * * *